US005683290A

United States Patent [19]

Kanda et al.

[11] Patent Number: 5,683,290

[45] Date of Patent: Nov. 4, 1997

[54] APPARATUS FOR FORMING A CONVEX TIP ON A WORKPIECE

[75] Inventors: Torahiko Kanda; Masashige Mitsuhashi, both of Tokyo, Japan

[73] Assignee: NEC Corporation, Tokyo, Japan

[21] Appl. No.: 734,098

[22] Filed: Oct. 21, 1996

Related U.S. Application Data

[63] Continuation of Ser. No. 444,741, May 19, 1995, abandoned.

[30] Foreign Application Priority Data

May 23, 1995 [JP] Japan ..... 6-107330

[51] Int. Cl.[6] ..... B24B 3/08; B24B 5/14

[52] U.S. Cl. ..... 451/72; 451/41; 451/58; 451/214; 451/242; 451/256; 451/544

[58] Field of Search ..... 451/41, 42, 43, 451/56, 57, 65, 72, 58, 177, 212, 213, 214, 218, 226, 242, 256, 272, 259, 273, 274, 276, 277, 283, 542, 540, 541, 544, 548

[56] References Cited

U.S. PATENT DOCUMENTS

| | | | |
|---|---|---|---|
| 2,352,146 | 6/1944 | Desenbag . | |
| 3,067,551 | 12/1962 | Maginnis | 451/544 |
| 4,839,993 | 6/1989 | Masako et al. | 451/283 |
| 5,048,238 | 9/1991 | Ikeda | 451/42 |
| 5,149,337 | 9/1992 | Watanabe | 451/256 |
| 5,216,846 | 6/1993 | Takahashi | 451/285 |

FOREIGN PATENT DOCUMENTS

| | | | |
|---|---|---|---|
| 131195 | 10/1979 | Japan | 451/544 |
| 34763 | 2/1987 | Japan | 451/42 |
| 316166 | 12/1989 | Japan | 451/42 |
| 63-102863 | 1/1992 | Japan . | |

*Primary Examiner*—Timothy V. Eley

*Attorney, Agent, or Firm*—Laff, Whitesel, Conte & Saret, Ltd.

[57] ABSTRACT

A method and an apparatus for forming a hemispherical convex mirror surface on the end of a ferrule or optical fiber connector efficiently and accurately. The apparatus has a grinding wheel having a concave work surface, a tool for correcting the shape of the work surface, a stage for bringing the tool into contact with the wheel, a mechanism for causing the end of the ferrule to contact the work surface, and a mechanism for displacing the axis of the ferrule from the center of the curvature of the arcuate section of the work surface. After the axis of the ferrule has been displaced from the center of the curvature, the ferrule is caused to contact the work surface and roughly ground thereby. Subsequently, after the ferrule axis has been brought into alignment with the center of curvature, the ferrule is sequentially finished from the tip to a preselected point thereof.

1 Claim, 5 Drawing Sheets

APPARATUS FOR FORMING A CONVEX TIP ON A WORKPIECE

This application is a continuation of application Ser. No. 08/444,741, filed May 19, 1995 now abandoned.

BACKGROUND OF THE INVENTION

The present invention relates to a method of forming a hemispherical convex tip on a workpiece, e.g., a ferrule or optical fiber connector or a cylinder or block made of glass, ceramic or plastic, and an apparatus therefor.

Optical fibers are extensively used for the transmission of optical signals and generally connected to each other by an optical PC (Physical Contact) connector. The PC connector consists of ferrules respectively provided on the ends of fibers to be connected. The ferrule each has a hemispheric convex tip having a mirror surface in order to ensure the close contact of the fibers. This kind of connector successfully reduces optical losses attributable to a gap between the ends of the fibers. A method of providing the ferrule with a convex tip is disclosed in, for example, Japanese patent Laid-Open Publication No. 63-102863 (corresponding to Japanese Patent Publication No. 4-2388).

However, the conventional method is time-consuming because it involves a number of steps. In addition, tools for practicing the method must be frequently replaced, resulting in low productivity.

SUMMARY OF THE INVENTION

It is, therefore, an object of the present invention to provide a method of providing a workpiece of the kind described with a convex mirror-surface tip efficiently and accurately, and an apparatus therefor.

In accordance with the present invention, a method of forming a convex mirror surface on the end of a workpiece has the steps of preparing a grinding wheel having, on the circumference thereof, a concave work surface having an arcuate section, rotating the wheel coaxially with the work surface, rotating the workpiece about an axis parallel to the center of a radius of curvature of a section of the work surface, roughly grinding the workpiece by displacing the center and axis relative to each other and by pressing the end of the workpiece against the work surface, and finish-grinding the workpiece after bringing the center and axis into alignment with each other.

Also, in accordance with the present invention, an apparatus for forming a convex mirror surface on the end of a workpiece has a grinding wheel having, on the circumference thereof, a concave work surface having an arcuate section, and rotatable concentrically with the work surface. A drive source holds the workpiece and causes it to rotate about an axis parallel to the center of a radius of curvature of a section of the work surface. A moving mechanism moves the workpiece along the axis to thereby press the end of the workpiece against the work surface. A displacing mechanism selectively displaces the axis relative to the center such that the workpiece is roughly ground when the axis and center are out of alignment and is finish-ground when they are in alignment.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
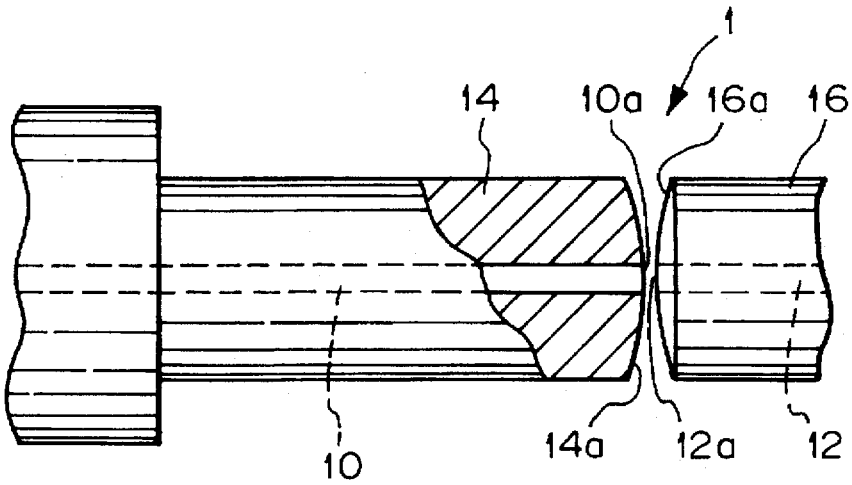
FIG. 1 is a section of a ferrule constituting an optical fiber connector.
Figure 2A:
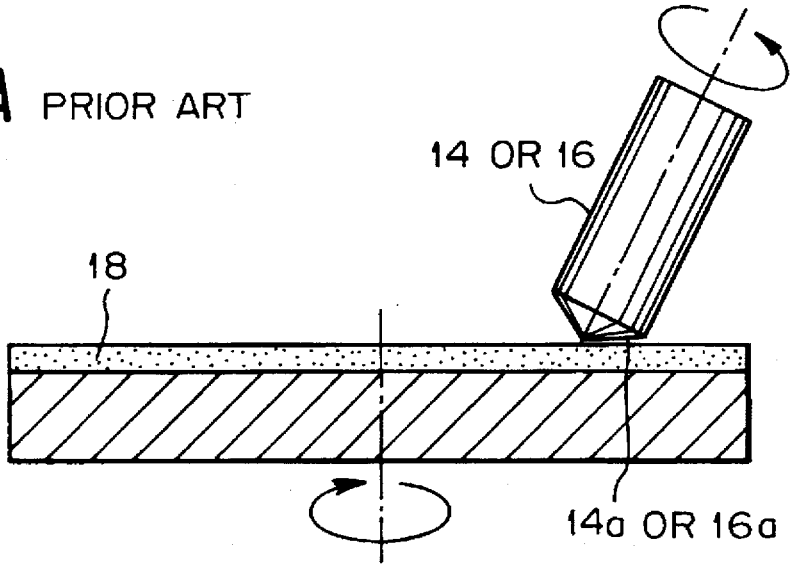
Fig. 2A PRIOR ART
FIGS. 2A and 2B are sections demonstrating a conventional grinding procedure.
Figure 2B:
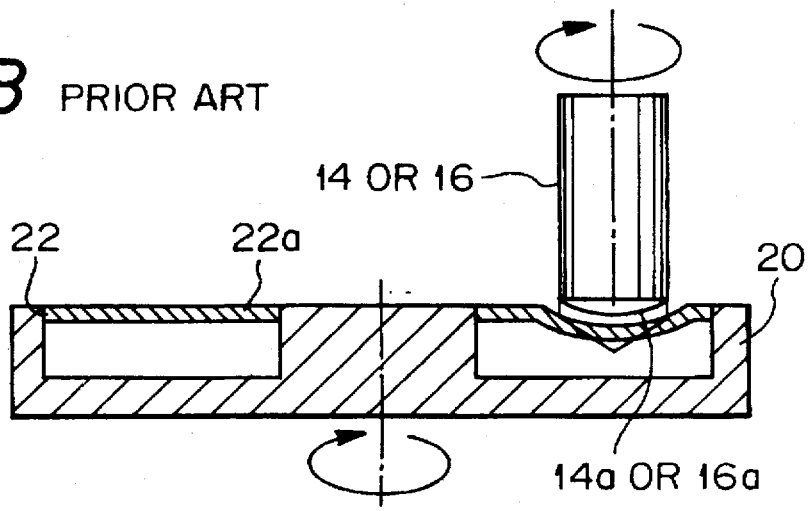
Fig. 2B PRIOR ART

Referring to FIG. 1 of the drawings, a PC connector is shown and generally designated by the reference numeral 1. As shown, the connector 1 connects two optical fibers 10 and 12 having end faces 10*a* and 12*a*, respectively. The connector 1 minimizes optical losses occurring during the propagation of optical signals due to a gap between the end faces 10*a* and 12*a*. Specifically, ferrules 14 and 16 are respectively provided on the ends of the fibers 10 and 12, and each has its end face 14*a* or 16*a* ground to have a hemispherical convex mirror surface. In this configuration, the end faces 10*a* and 12*a* of the fibers 10 and 12 are held in close contact with each other. Excess part of the fibers 10 and 12 and excess adhesive deposited on the ends of the fibers 10 and 12 during fabrication are removed by rough grinding. FIG. 2A illustrates the conventional grinding technology taught in previously mentioned Laid-Open Publication No. 63-102863. As shown, the end 14*a* or 16*a* of the ferrule 14 or 16 is provided with a conical shape by grinding using a grinding wheel 18 or by lapping using free abrasive grain. Further, as shown in FIG. 2B, an elastic sheet 22 is spread on a rotary disk 20 while fine abrasive grain 22*a* is scattered on the sheet 22. The ferrule 14 or 16 is rotated about its own axis while abutting against the sheet 22 at the end 14*a* or 16*a* thereof. As a result, the conical end 14*a* or 16*a* is finished to have a convex mirror surface due to the local deformation of the sheet 22 and the operation of the fine grain 22*a*.

A problem with the conventional procedure shown in FIGS. 2A and 2B is that two or more consecutive steps are necessary for the ferrule 14 or 16 to have the desired convex tip 14*a* or 16*a*. The procedure, therefore, consumes a long period of time, inclusive of the time loss due to the transfer of the ferrule 14 or 16 from one step to another. Moreover, the elastic sheet 22 and fine abrasive grain 22*a* must be frequently replaced in order to maintain their grinding ability constant. In addition, the grinding wheel 18 needs frequent dressing which lowers productivity.

Referring to FIGS. 3, 4, 5A and 5B, an apparatus embodying the present invention will be described. As shown, the apparatus, generally 30, has a metal-bonded grinding wheel 32 having a work surface 32*a* which is provided with a concave arcuate section. A ferrule 34 is a specific form of a workpiece applicable to the embodiment. Briefly, when the work surface 32*a* is moved and the ferrule 34 is rotated about its own axis, the concave arcuate section of the surface 32*a* is transferred to the end 34*a* of the ferrule 34. As a result, the end 34*a* is provided with a smooth convex mirror surface.

Figure 3:
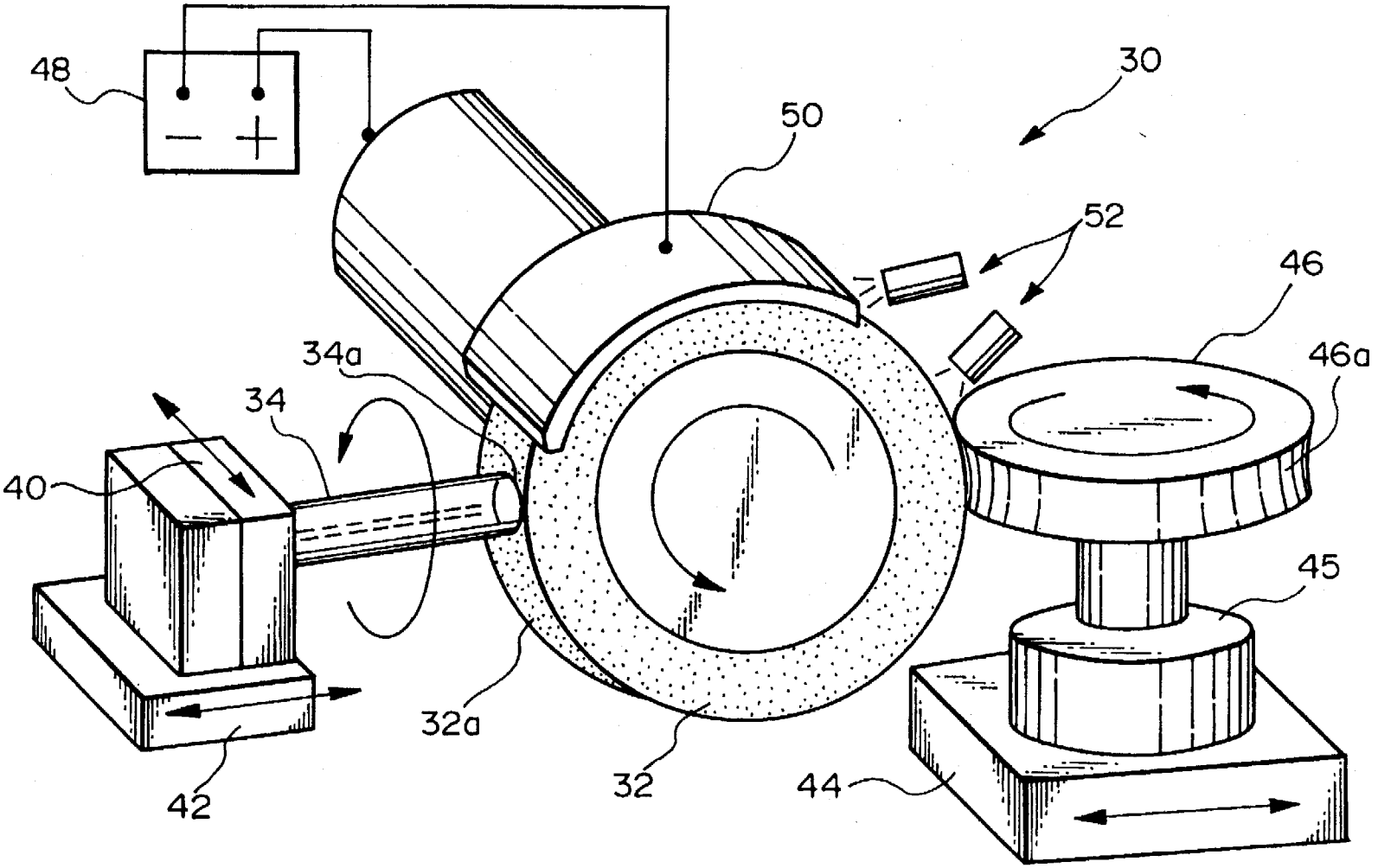
FIG. 3 is a perspective view of an apparatus embodying the present invention.
Figure 4:
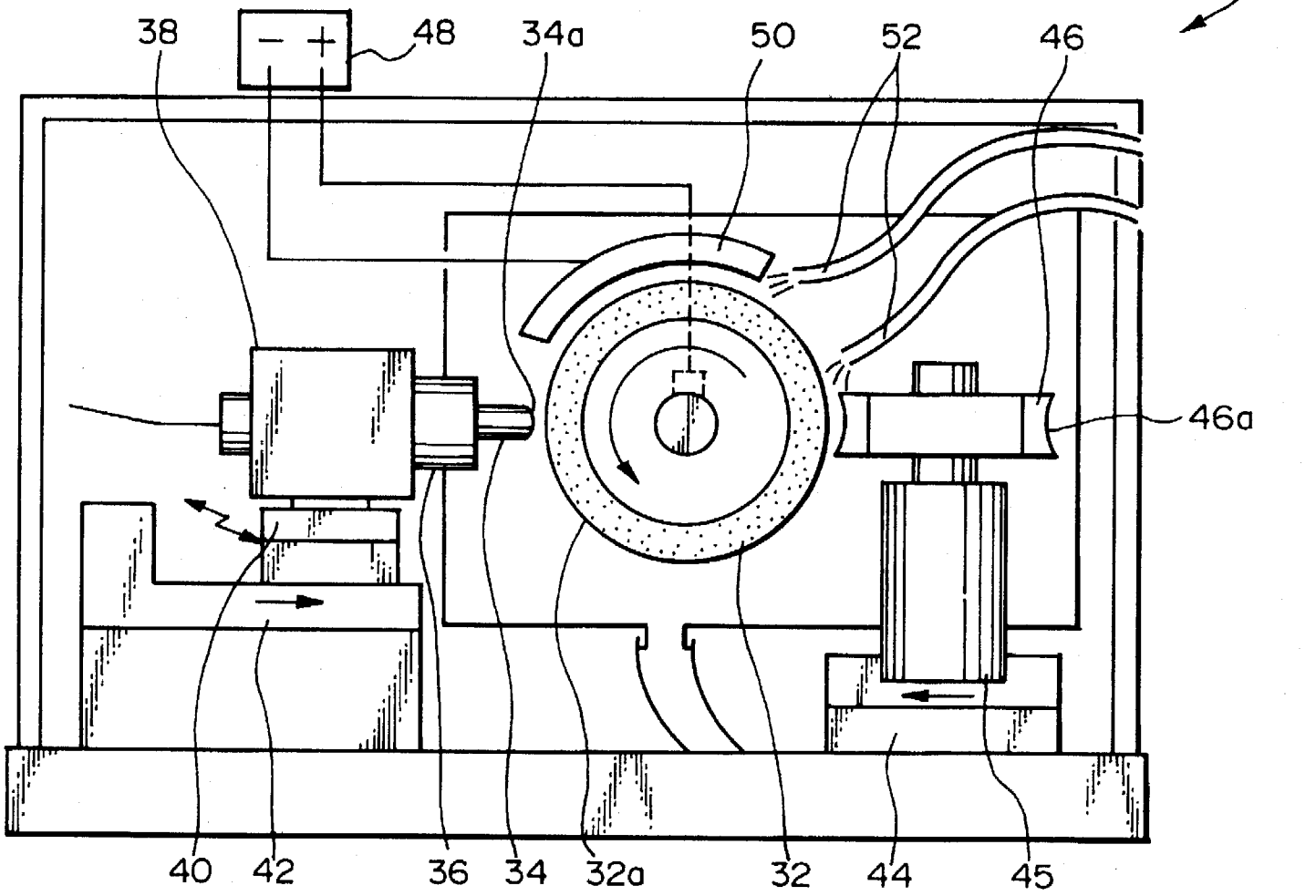
FIG. 4 is a plan view of the embodiment.

Specifically, the ferrule 34 is held by a chuck 36 and repeatedly rotated in opposite directions by a reversible motor 38. Neither the chuck 36 nor the motor 38 is shown in FIG. 3. A first mechanism 40 and a second mechanism 42 are respectively capable of moving the ferrule 34 in the axial direction of the wheel 32 and the radial direction of the same. A correcting tool 46 is mounted on a stage 44 and rotatable about an axis perpendicular to the axis of the wheel 32. The tool 46 is pressed against the wheel 32 and driven by a motor 45 to correct the arcuate section of the work surface 32*a* when it is disfigured. A voltage is applied from a power source 48 to between the wheel 32 and a negative electrode 50 adjoining the work surface 32*a*. At the same time, a weakly conductive abrasive liquid 52 is fed to the work surface 32*a*. The voltage and liquid 52 effect electrolytic dressing on the wheel 32 in order to maintain the ability of the work surface 32*a* constant and increase the life of the tool 46, i.e., to reduce the frequency of replacement of the wheel 32.

Figure 5A:
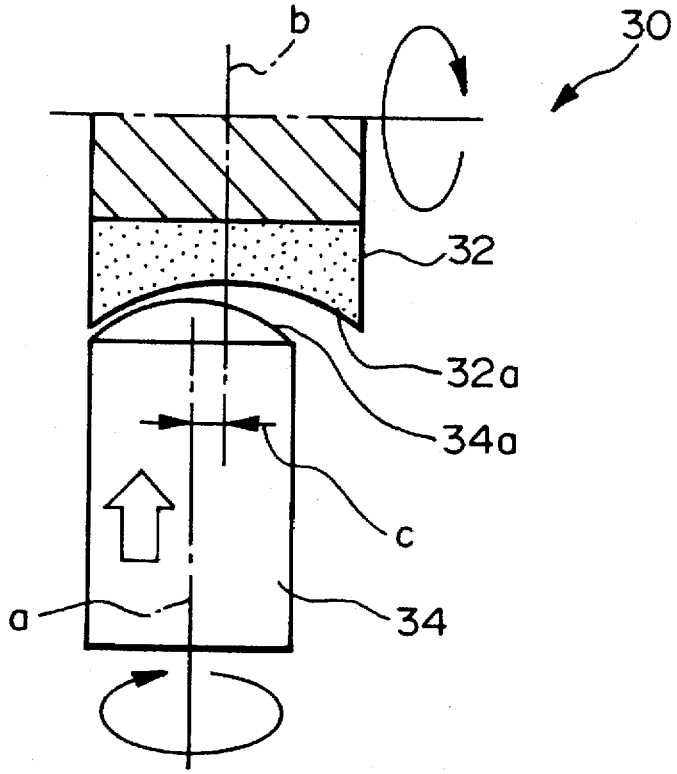
FIGS. 5A and 5B are sections showing a grinding wheel included in the embodiment and a ferrule to be ground thereby.

The operation of the apparatus 30 will be described with reference to FIGS. 5A and 5B. The ferrule 34 is rotatable about an axis a. The arcuate work surface 32*a*, has a center b of sectional curvature, i.e., a plane perpendicular to the axis of rotation of the wheel 32 and containing a point on the arc closest to the axis of rotation. First, as shown in FIG. 5A, the mechanism 30 displaces the axis a of the ferrule 34 from the center or plane b of the work surface 32*a* by a distance c. Then, the ferrule 34 is caused to contact the work surface 32*a*. In this condition, the work surface 32*a* grinds the ferrule end 34*a* to remove excess adhesive and excess part of the fiber. As a result, the ferrule end 34*a* is provided with a conical configuration. Subsequently, as shown in FIG. 5B, the mechanism 30 again brings the axis a into alignment with the center b. As a result, the ferrule end 34*a* is sequentially finished in a hemispherical configuration. When the ferrule end 34*a* is finished from the tip up to a predetermined point, the finishing operation ends.

As stated above, the embodiment can remove excess adhesive and excess fiber and then effect mirror-finishing without rechucking the ferrule 34 or replacing the wheel 32, thereby completing the procedure in a short period of time. Because the work surface 32 has its concave arcuate shape corrected by the tool 46, the wheel 32 can be repeatedly used until its portion indicated by dots in the figures wears out. This eliminates the frequent replacement of the abrasive grain 22*a* and elastic sheet 22, FIGS. 2A and 2B, and thereby allows ferrules to be ground without interruption.

Figure 5B:
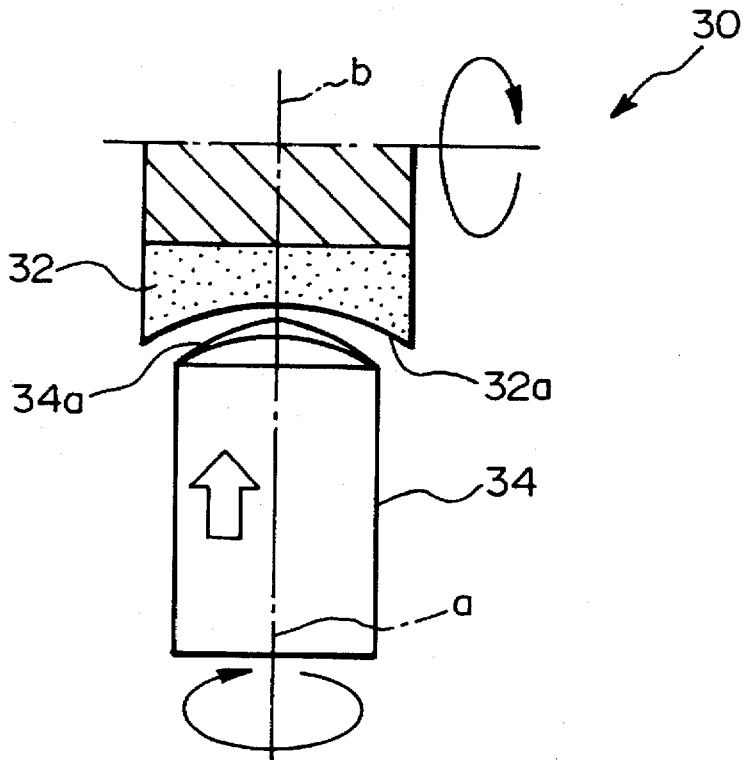

Further, as shown in FIGS. 5A and 5B, the portion of the work surface 32*a* that contacts the ferrule end 34*a* differs from the rough grinding shown in FIG. 5A to the finish grinding shown in FIG. 5B. It is, therefore, possible to extend the life of the wheel 32 by reducing the frequency of shape correction.

Experimental grinding conditions are as follows. The wheel 32 was of a bronze-bonded straight type having an outside diameter of 75 mm and a thickness of 5 mm, and implemented by 4,000 mesh diamond grain. The correcting tool 46 was resin-bonded and had an outside diameter of 40 mm and a thickness of 5 mm. The tool 46 was implemented by 3,000 mesh diamond grain. The wheel 32 was rotated at a speed of 2,000 rpm while the motor 45 assigned to the tool 46 was rotated at a speed of 100 rpm. The stage 44 was moved to bring the work surface 46*a* of the tool 46 toward the work surface 32*a* of the wheel 32 in the relation shown in FIG. 3. The work surface 46*a* was caused to contact the work surface 32*a* under the supply of the abrasive liquid 52. The surface 42*a* formed in the surface 32*a* a concavity having an arcuate section whose radius of curvature was 20 min. The concavity has the same radius of curvature as the tool 46 without regard to the kinds of bond or the kinds of abrasive grain of the wheel 32 and tool 46.

In the above condition, a DC voltage was applied from the power source 48 to between the negative electrode 50 and the wheel 32, thereby effecting electrolytic dressing on the surface 32*a*. Specifically, immediately before the rough grinding of the ferrule end 34*a*, the dressing was executed for 15 seconds by a current of 2.5 Å. The dressing caused the abrasive grain distributed on the work surface 32*a* to protrude and thereby provided the surface 32*a* with a desirable grinding ability. Subsequently, the ferrule 34 is held by the chuck 36 and then rotated about its own axis by the reversible motor 38. The mechanism 40 shifted the axis a of the ferrule 34 by a distance c of 500 μm away from the previously stated center b of the work surface 32*a*. Then, the second mechanism 42 moved the ferrule 34 at a constant rate until it contacts the work surface 32*a*. In this condition, the ferrule 34 was roughly ground for 20 seconds. After the rough grinding, the mechanism 40 again brought the axis a into alignment with the center b. Then, the mechanism 43 held the ferrule 34 in contact the work surface 32*a* for 5 more seconds in order to finish the ferrule end 34*a*. During the finish grinding, the electrolytic dressing is effected by the current of 2.5 Å, and the motor 38 is rotated at a speed of 50 rpm in such a manner as to reverse the direction of the ferrule 34 every four rotations.

When the arcuate section of the work surface 32*a* was disfigured and failed to provide the ferrule end 34*a* with the desirable convexity, the stage 44 was again moved to bring the tool 46 into contact with the wheel 32. As a result, the surface 32*a* was corrected to the accurate concavity. The ferrule end 34*a* was found to have a smooth convex mirror surface whose radius of curvature was the same as that of the surface 32*a*, i.e., 20 mm and whose surface roughness was less than 0.08 μm Rmax.

For a given degree of finishing, the embodiment reduced the grinding time to less than one-half of the conventional grinding time. Further, the embodiment reduced the time loss attributable to the replacement of tools to less than one-fiftieth. In addition, because the wear of the work surface 32*a* was distributed to the intermediate portion and peripheral portion, the embodiment reduced the correcting time necessary for the surface 32*a* and the wear of the wheel 32 attributable to the correction to less than two-thirds, compared to the conventional case wherein only the intermediate portion of the surface 32*a* is used.

Figure 6A:
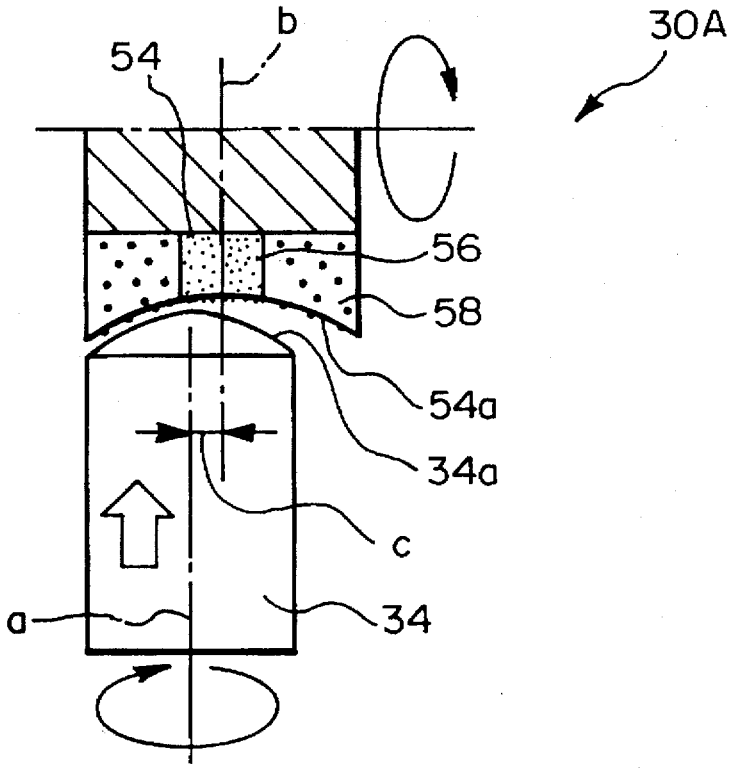
FIGS. 6A and 6B are sections showing an alternative embodiment of the present invention.
Figure 6B:
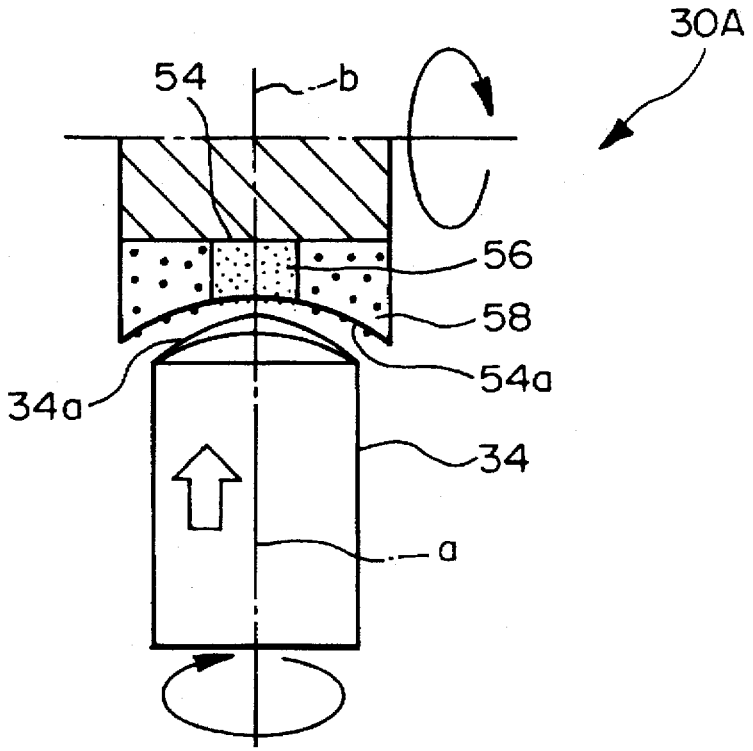

FIGS. 6A and 6B show an alternative embodiment of the present invention. As shown, the apparatus, generally 30A, has a grinding wheel 54 having fine abrasive grain 56 and rough abrasive grain 58. The fine grain 56 is positioned at the intermediate portion of a work surface 54*a*, as viewed in a section, while the rough grain 58 is positioned at opposite edge portions of the same. First, the axis a of the ferrule 34 is shifted from the center b of the grindstone 54 by the distance c. Then, the ferrule end 34*a* is ground at a high speed by the rough grain 58. After the axis a has been again brought into alignment with the center b, the ferrule end 34*a*, roughly ground by the grain 58, is finished by the fine grain 56. It is to be noted that the grain 58 extends from each edge of the work surface 54*a* to the point which is remote from the center b by the distance c. The wheel 54 having such a configuration can grind the ferrule 34 with higher accuracy than a wheel having only the rough grain 58, and can mirror-finish the ferrule 34 in a shorter period of time than a wheel having only the fine grain 56.

The wheel 54 was used to grind the ferrule 34 under the previously stated conditions except for the following. As shown in FIGS. 6A and 6B, the wheel 54 was provided with 4,000 mesh diamond grain over the width of 1.5 mm at the intermediate portion, and 600 mesh diamond grain at the edge portions. The mechanism 40 shifted the axis a of the ferrule 34 from the center b of the work surface 54*a* by the distance c of 800 μm. Then, the ferrule end 34*a* was roughly ground by the grain 58. The grain of 600 mesh is higher in grinding speed than the mesh of 4,000 mesh although it increases the surface roughness of the workpiece. Even when the ferrule end 34*a* was brought into contact with the work surface 54*a* at a speed twice as high as the speed in the previous embodiment, the resulting convex tip was comparable in quality with the tip available with the previous embodiment. As a result, the wheel 54 reduced the rough grinding time to one-half, compared to a wheel implemented only by the 4,000 mesh grain.

In the illustrative embodiments, the ferrule 34 is implemented as a glass cylinder accommodating a quartz fiber therein. The embodiments were found to provide even a ferrule made of zirconia ceramic or plastic or any other cylindrical or block-like workpiece with an accurate convex mirror surface.

While the wheel 32 or 54 has been shown and described as having a work surface on the circumference thereof, it may be provided with a work surface concentric with the axis on one major surface thereof. Then, the axis of the workpiece will be positioned in parallel to the axis of the wheel; the center of the sectional radius of curvature will be a cylinder concentric with the axis of the wheel and containing a circle defined by the bottom of the work surface.

In the embodiments, the reversible motor 38 is used to rotate the ferrule 34 in opposite directions repeatedly because a long optical fiber is generally connected to the ferrule 34. A workpiece to which an optical fiber or the like is not connected may be simply rotated in only one direction.

In summary, it will be seen that the present invention provides an apparatus capable of providing a ferrule or optical fiber connector, a single workpiece made of glass, ceramic or plastic, or a composite workpiece with a hemispherical tip in a shorter period of time and with greater accuracy than conventional apparatuses. In addition, the apparatus of the invention noticeably reduces the frequency of replacement of tools and thereby enhances productivity.

Various modifications will become possible for those skilled in the art after receiving the teachings of the present disclosure without departing from the scope thereof.

What is claimed is:

1. An apparatus for forming a finish-ground convex end face on an optical fiber connector, said apparatus comprising:

a grinding wheel having a work surface with a concave arcuate profile for grinding an end face of the optical fiber connector;

rotary correcting means having a work surface for correcting said concave profile of said work surface of said grinding wheel;

means for respectively causing the optical fiber connector, said grinding wheel, and said rotary correcting means to rotate;

a first moving mechanism for causing said work surface of said grinding wheel and said work surface of said rotary correcting means to contact each other in order to provide said work surface of said grinding wheel with a concave arcuate section;

a second moving mechanism for causing the end face of the optical fiber connector and said work surface of said grinding wheel to contact each other in order to grind the end face;

a displacing mechanism for displacing an axis of rotation of the optical fiber connector from a center of curvature of said work surface of said grinding wheel having the concave arcuate section, and for again bringing, after said work surface has roughly ground the end face of the optical fiber connector into a conical configuration, the axis of rotation of the optical fiber connector into alignment with the center of curvature of said work surface to allow said work surface to finish-grind the end face;

said grinding wheel having fine grains suitable for finish-grinding located at a center of a section of said grinding wheel; and said grinding wheel having coarse grains suitable for rough grinding located at both sides of the center of the section of said grinding wheel.

* * * * *